United States Patent [19]

Wahlquist

[11] 4,074,475

[45] Feb. 21, 1978

[54] COLLAPSIBLE ROOM MODULE CONSTRUCTION AND METHOD OF ASSEMBLY

[75] Inventor: Carl D. Wahlquist, Woodland Hills, Calif.

[73] Assignee: Building Components Research, Inc., Los Angeles, Calif.

[21] Appl. No.: 763,437

[22] Filed: Jan. 28, 1977

[51] Int. Cl.[2] ..... E04B 1/343

[52] U.S. Cl. ..... 52/70; 52/79.6; 52/143; 52/741

[58] Field of Search ..... 296/23 F, 23 G, 26, 296/27, 23; 52/71, 70, 66, 67, 143, 79.6, 741, 745

[56] References Cited

U.S. PATENT DOCUMENTS

| | | | |
|---|---|---|---|
| 1,226,194 | 5/1917 | DeSmidt | 52/70 |
| 2,229,908 | 1/1941 | Wenneborg | 52/66 |
| 2,860,384 | 11/1968 | Wait | 296/23 G |
| 2,886,856 | 5/1959 | Che | 296/23 G |
| 3,012,291 | 12/1961 | Rice | 52/70 |
| 3,348,344 | 10/1967 | Tatevossian | 52/69 |
| 3,402,515 | 4/1968 | Rainaut | 52/71 |
| 3,778,100 | 12/1973 | Dillard | 52/67 |
| 3,863,404 | 2/1975 | Wahlquist | 52/143 |

FOREIGN PATENT DOCUMENTS

| | | | |
|---|---|---|---|
| 2,425,649 | 11/1975 | Germany | 52/66 |

*Primary Examiner*—John E. Murtagh
*Attorney, Agent, or Firm*—H. Ross Workman; J. Winslow Young

[57] ABSTRACT

A collapsible room module assembly having a foldable ceiling construction is provided for transforming a large open space into a plurality of smaller rooms. Two ceiling panels are hinged to accommodate folding of one of the ceiling panels with respect to the other when it is desired to collapse the room and store the foldable ceiling. Wheels are attached to one of the ceiling panels and are adapted to engage a tubular insulation strip which is situated at the top of the wall panels of the collapsible room and which serves as a track for guiding the wheels of the foldable ceiling as it is folded or unfolded. Apparatus is provided for disengaging the wheels of the foldable ceiling from the tubular strip once the ceiling has been completely unfolded, thereby allowing the weight of the ceiling unit to compress the insulation strip so as to form an acoustic and hermetic seal between the wall panels and unfolded ceiling unit. A dividing wall which is integral with the side wall panel between each pair of rooms formed by the wall panels is provided so that the side wall panels between rooms can be opened up, thereby varying the size of the room formed.

17 Claims, 7 Drawing Figures

COLLAPSIBLE ROOM MODULE CONSTRUCTION AND METHOD OF ASSEMBLY

BACKGROUND

1. Field of the Invention

This invention relates to building construction and more particularly to structure and method for transforming a large space into smaller spaces.

2. The Prior Art

It has long been desirable to achieve maximum utility of space by providing structure for selectively dividing a large space into smaller spaces or rooms of varying sizes. Conventionally, movable wall partitions or dividers have been used for this purpose. See, for example, U.S. Pat. Nos. 3,107,400; 3,295,257 and 3,331,426.

Numerous problems have traditionally been associated with conventional wall partitions which have made their widespread use either impractical or undesirable. For example, most wall partitions are incapable of being situated so as to provide an acoustically and hermetically insulated space. Where attempts have been made to form insulated spaces, the structure involved has been undesirably complex.

More recently, apparatus has been provided for assembling stationary room modules from an assembly of interior wall panels which are easily displaced from a folded position to an unfolded, enclosure-forming position. An elevated ceiling unit is thereafter lowered upon the unfolded wall panels so as to form acoustic and hermetic insulation at the top and bottom panel joints, the weight of the ceiling simultaneously downwardly displacing the wall panels to secure the wall panels in the unfolded position and also forming a seal between the wall panels and ceiling unit by compressing an insulation strip. See, for example, U.S. Pat. No. 3,863,404 and 3,869,841. Similarly, apparatus has also been provided for assembling portable room modules which can be used to selectively transform a large space into a plurality of smaller spaces by transporting the module to any predetermined location and thereafter unfolding an assembly of wall panels into an enclosure-forming configuration. A ceiling unit is thereafter lowered upon the portable room module so as to form an acoustic and hermetic insulation at top and bottom panel joints. See, for example, U.S. Pat. No. 3,984,949.

However, it has been found with the more recent apparatus for collapsible room modules such as that described above, that placement onto the room and storage when not in use of the ceiling units for such modules is particularly difficult due to the size and weight of the ceiling unit, which is needed to form the insulation seal and secure the room. Thus, it has been found that the ceiling units used with the collapsible room modules of the prior art greatly detract from the flexibility and facility with which such modules may be used to transform a large space into a plurality of smaller rooms.

The more recent collapsible room module apparatus also does not allow for any variety in the size of the rooms formed by the assembly of wall panels.

It would therefore be desirable to provide a collapsible room module assembly that has a ceiling unit which, when desired, may be quickly and easily folded into a convenient storage configuration or unfolded and guided accurately onto the unfolded room module.

It would also be desirable to provide for a collapsible room module assembly which has the capability of allowing the size of the rooms formed by the wall panels to be selectively varied.

BRIEF SUMMARY OF THE OBJECTS OF THE INVENTION

The present invention, including structure and method, provides a room module having a foldable ceiling unit formed from a plurality of ceiling panels which are hinged together to accommodate folding of the ceiling unit into a convenient storage configuration when the collapsible room module is not in use and unfolding the ceiling unit when it is desired to use the room module. The foldable ceiling unit is provided with structure for accurately and easily guiding the ceiling unit onto the room as it is unfolded. Structure is also provided for accommodating the formation of an acoustic and hermetic seal around the ceiling unit once it is in the unfolded position. The room module of the present invention also provides apparatus which enables rooms of varying sizes to be formed by the wall panels.

It is therefore a primary object of the present invention to provide an improved collapsible room module having a ceiling unit which may be selectively folded into a storage configuration or unfolded for use as a ceiling.

It is another primary object of the present invention to provide an improved method for guiding the ceiling unit into place as it is unfolded and thereafter forming an acoustic and hermetic seal around the edges of the ceiling.

Yet another important object of the present invention is to provide apparatus which enables the room module assembly to be used to form rooms of varying size.

These and other objects and features of the present invention will become more fully apparent from the following description and appended claims taken in conjunction with the accompanying drawing.

DETAILED DESCRIPTION OF THE PREFERRED EMBODIMENTS

Reference is now made to the drawings wherein like parts are designated with like numerals throughout.

Figure 1:
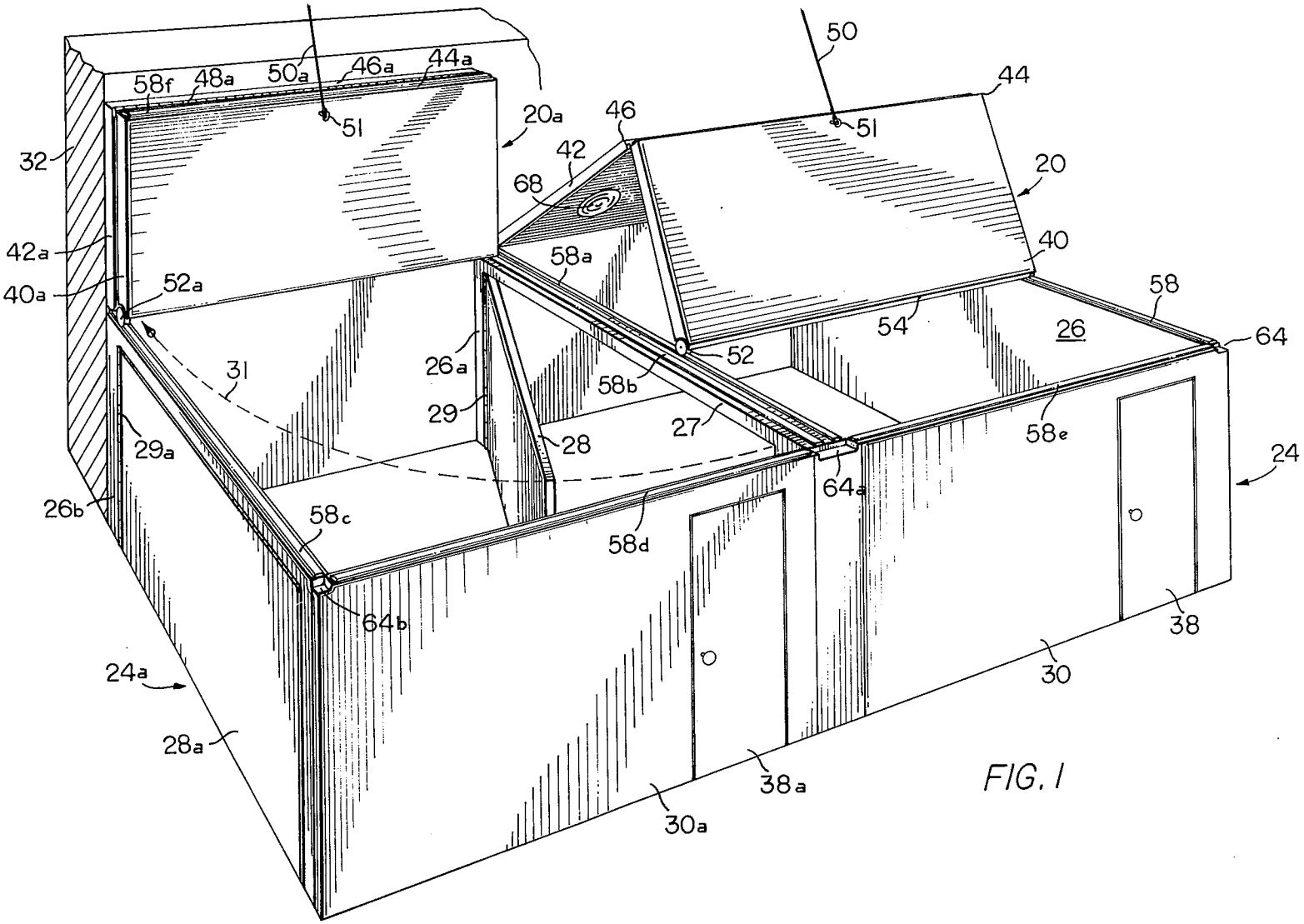
FIG. 1 is a schematic perspective view of one presently preferred embodiment of a foldable ceiling unit and a dividing wall used in conjunction with a stationary room module assembly.

As shown in FIG. 1, the foldable ceiling unit generally designated 20 may be used in conjunction with a stationary room module assembly generally designated 24. Adjacent ceiling units such as 20*a* and adjacent stationary room module assemblies such as 24*a* are substantially identical in construction and operation with foldable ceiling unit 20 and stationary room module assembly 24. For ease of reading, like parts on adjacent units will be designated with like numerals having lower case letters.

Figure 2:
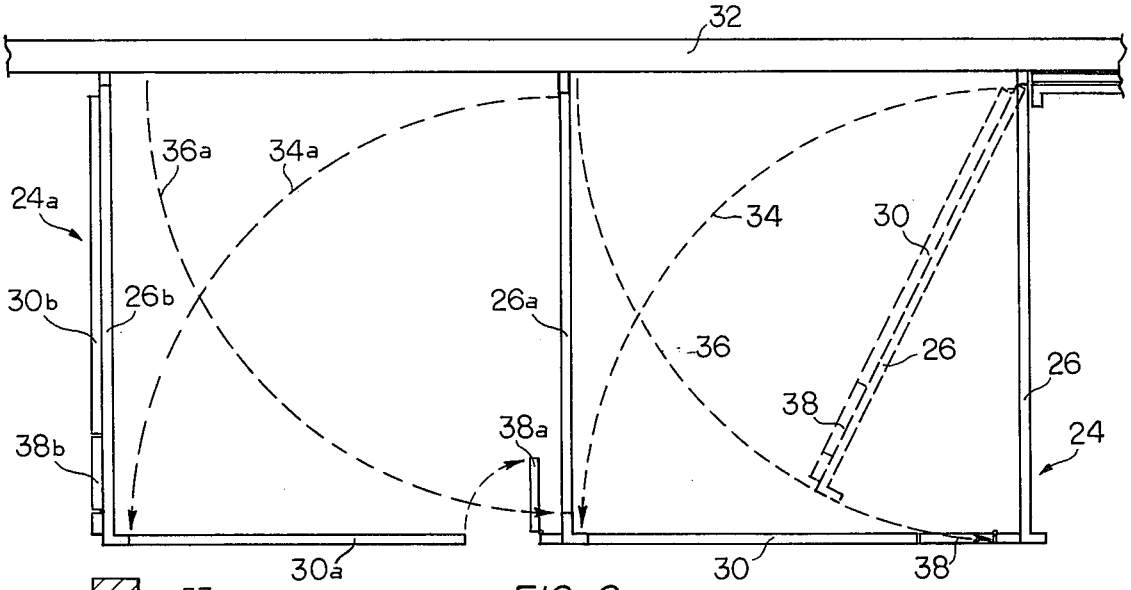
FIG. 2 is a schematic plan view of the unfolding sequence of adjacent wall panels of the stationary room module assembly shown in FIG. 1.

Referring now to FIG. 2, it will be seen that each stationary room module assembly 24 may be unfolded as illustrated to form an enclosure, thereby transforming a large space into one or more smaller spaces. As shown in FIG. 2, wall panels 26 and 30 are unfolded by first arcuately displacing the wall panels 26 and 30 in the direction of arrow 36 until the side wall panel 26 is essentially normal with respect to the support wall 32. Thereafter, the front wall panel 30 is arcuately displaced along the path defined by arrow 34 to a position essentially parallel with support wall 32. Displacement of the wall panels 26 and 30 is facilitated by suspending wall panels 26 and 30 on a plurality of spring loaded rollers (not shown) such as those disclosed in U.S. Pat. No. 3,863,404. Once unfolded, the wall panels 26 and 30 are secured by a hand-operable lever (not shown) which operates to latch front wall panel 30 to side wall panel 26 at adjacent edges. Each front wall panel 30 contains a door 38 which permits access into and out of the enclosure formed by wall panels 26 and 30. Once the wall panels 26 and 30 for each stationary room module assembly 24 have been unfolded in the manner indicated, the enclosure formed by the unfolded wall panels 26 and 30 is then ready to receive the ceiling unit 20. Stationary room module assemblies of the type described above are known in the art (see, for example, U.S. Pat. Nos. 3,863,404 and 3,869,841) and may be purchased from Building Components Research, Inc. of Salt Lake City, Utah.

Referring again to FIG. 1, it will be seen that each ceiling unit 20 may be selectively unfolded as hereinafter more fully described. Likewise, when it is desired to store the stationary room module assembly 24, each ceiling unit 20 may be folded up in the manner illustrated by ceiling unit 20*a* into a storage configuration. Each foldable ceiling unit 20 has at least two ceiling panels 40 and 42. Adjacent edges 44 and 46 of the ceiling panels 40 and 42 are joined along substantially their entire length by a hinge (not shown) similar to hinge 48*a* on ceiling unit 20*a*, thereby allowing the ceiling panels 40 and 42 to be selectively folded or unfolded with respect to each other in the manner illustrated in FIG. 1. It should be noted that while a piano hinge 48*a* has been illustrated, any suitable type of hinge structure could be used. It should also be noted that any suitable number of panels could be hinged to accommodate the desired folding action of the ceiling unit.

The ceiling unit 20 is mounted on support wall 32 at a height that exceeds the height of the wall panel 26 by approximately the width of the ceiling panel 42. This allows the adjacent edge of ceiling panel 42 to fit flush with the top edge of the wall panel 26 when the ceiling unit 20 is unfolded. Ceiling unit 20 is mounted on support wall 32 by a rotatable hinge (not shown) along the lower edge of panel 42. The weight of ceiling unit 20 is supported by a cable 50.

Figure 3:
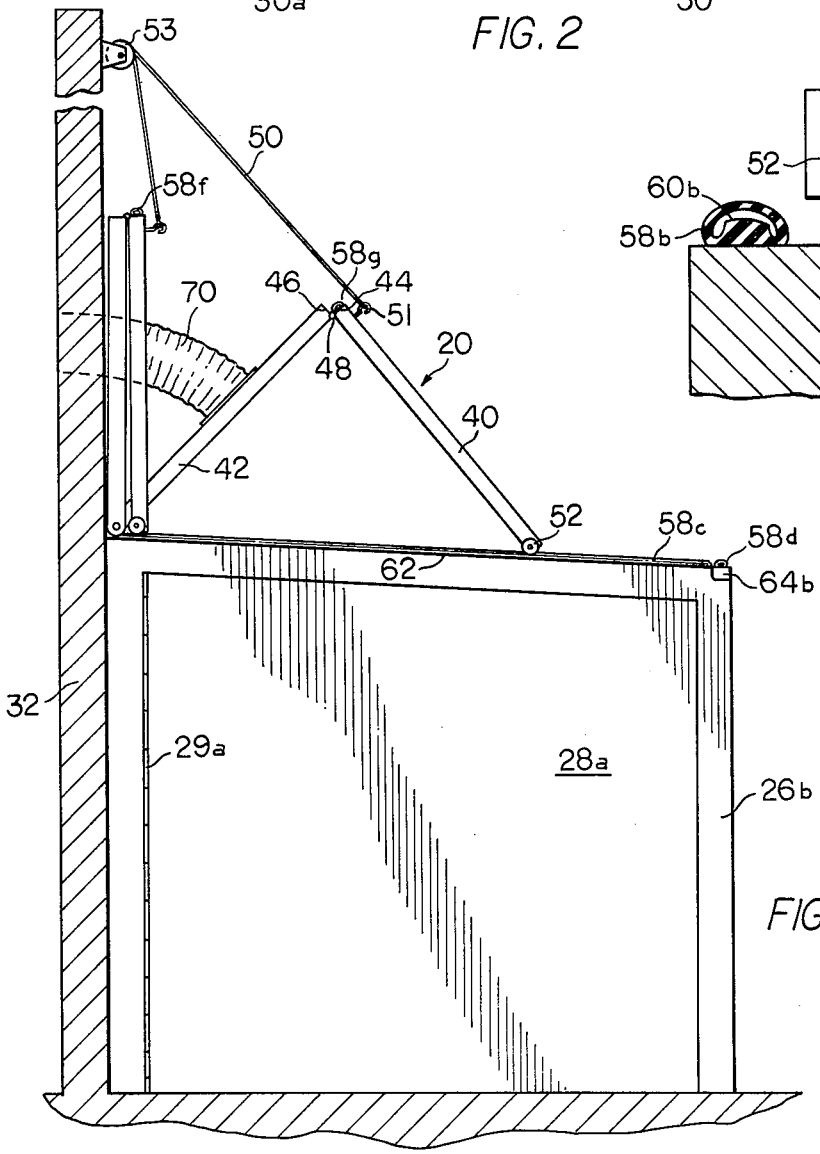
FIG. 3 is a side elevational view shown partially in cross section of the foldable ceiling unit and stationary room module assembly illustrated in FIGS. 1 and 2.

As shown more clearly in FIG. 3, the cable 50 is attached at one end to a hook 51 on ceiling panel 40 and to a winch assembly 53 at the other end. The winch assembly 53 may be electrically operated at a conveniently located control panel (not shown) which is within arm's reach to selectively draw in or let out the cable 50, thereby causing the ceiling unit 20 to be either folded up into a storage configuration such as that illustrated by ceiling unit 20*a* in FIG. 1 or unfolded so as to cover the enclosure formed by the room unit assembly 24. Although for purposes of illustration only one cable has been shown, it will be appreciated that a cable could be attached to ceiling panel 40 at both sides, midway between wheels 52 and hinged edge 44. The two cables would be drawn in by the winch assembly 53 and would be aligned by a set of pulleys (not shown) so as to be normal to the winch 53 when being drawn in or let out. The use of two cables would increase the stability of ceiling unit 20 when being folded or unfolded.

Figure 4:
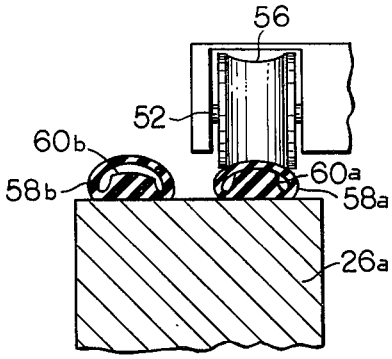
FIG. 4 is a fragmentary cross-sectional view particularly illustrating the interaction of the tubular insulation strip with the wheels of the foldable ceiling unit as it is being unfolded.

The method for guiding the celing unit 20 onto the enclosure formed by the unfolded room module assembly 24 is best understood by reference to FIGS. 1, 3 and 4. Wheels 52 are attached to both ends of the leading edge 54 of front ceiling panel 40. The wheels 52 may be mounted flush with the sides of ceiling panel 40 as shown in FIG. 1, or they may be mounted on axles within a housing provided in the forward corners of ceiling panel 20 as shown in FIG. 4. In either embodiment, the wheels 52 freely rotate about the axle. Referring again to FIG. 4, each wheel 52 has a concave rolling surface 56 which allows the wheel 52 to engage a combination track and tubular insulation strip 58 as will be more fully described in subsequent portions of the specification.

Referring again to FIGS. 1, 3 and 4, it will be seen that the top edge of each side panel 26 has along substantially its entire length a tubular insulation strip 58. The insulation strip 58 is formed of a suitable resilient flexible material such as rubber or neoprene and has a generally tubular configuration as shown more clearly in FIG. 4. An inwardly projecting rib such as 60*a* (shown in FIG. 4) traverses the length of the hollow of each tubular strip 58. Significantly, the rib 60*a* prevents total collapse of the tubular insulation strip 58*a* as the wheels 52 of the foldable ceiling unit 20 travel along the length of the tubular strip 58*a* when the ceiling unit 20 is unfolded. In this manner, the tubular strip 58*a* acts as a track for guiding the wheels 52 of the ceiling unit as it is unfolded, thereby insuring accurate placement of the ceiling unit 20 onto the enclosure formed by the room module 24. This prevents the ceiling unit 20 from slipping off of the room module 24 as it is being unfolded, and reduces noise from the wheels.

As more clearly illustrated in FIG. 3, the top edge of each side wall panel 26 forms a downwardly sloping incline similar to the incline 62 of panel 26*b*. As noted previously, a combination track and insulation strip 58 is attached to the edge of each side wall panel 26. Thus, as illustrated in FIG. 3 by insulation strip 58*c*, each strip 58 forms part of the downwardly sloping incline 62. It has been found that when the ceiling unit 20 is first unfolded, it is difficult to initiate the unfolding action. Thus, by providing a downwardly sloping incline 62, the gravitational force exerted on the ceiling panel 40 will help to start the unfolding action as soon as the cable 53 is let out.

As further illustrated by FIGS. 1 and 3, notches 64 have been provided at the end of each of the side wall panels 26. The notches 64 are positioned so that when the foldable ceiling 20 has been substantially completely unfolded, the notches 64 will receive the wheels 52, thereby allowing each of the ceiling panels 40 and 42 to lay essentially flat on the tubular insulation strip 58. Although for purposes of illustration the corners of the side wall panels 26 which abut notches 64 have been shown as perpendicular to the notches 64, it should be noted that these corners may be beveled to increase the ease of lifting the wheels 52 back onto the combination track and insulating strip 58 when folding up the ceiling unit 20.

Figure 5:
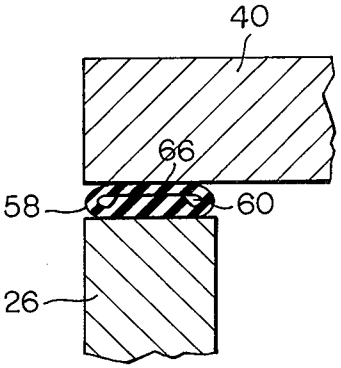
FIG. 5 is a fragmentary cross-sectional view of the tubular insulation strip when compressed to form an acoustic and hermetic seal between the unfolded ceiling unit and the wall panels of the room module.

In the unfolding mode, when notches 64 have received wheels 52 so as to disengage them from the insulation strip 58, substantially the entire weight of ceiling unit 20 will be placed on the insulation strip 58. As more clearly shown in FIG. 5, the weight of ceiling panels 40 and 42 will cause the outer wall 66 of the insulation strip 58 to be pressed against the rib 60. Since the rib 60 prevents total collapse of the tubular strip 58, dead air space will be formed along the length of strip 58 with the effect of providing a surprisingly effective acoustically and hermetically insulating seal.

As more clearly illustrated in FIG. 1, tubular insulation strips such as at **58*d* and 58*e* may also be provided along the top edge of front wall panels 30 and 30*a* to provide acoustic and hermetic insulation along the entire top edge of each room module 24. Furthermore, a tubular insulation strip such as that illustrated at 58*f* may also be provided between the adjacent hinged edges 44*a* and 46*a* of ceiling unit 20*a* so as to form an acoustic and hermetic seal between ceiling panels 40*a* and 42*a* when the foldable ceiling 20*a* is completely unfolded. In this manner, it will be seen that the foldable ceiling 20 may be adapted to completely seal off the top of the enclosure formed by the room module assembly 24** so as to preserve hermetic and acoustic insulation.

As further illustrated in FIGS. 1 and 3, an air flow duct 68 may be permanently installed and connected to a flexible conduit 70 for providing heat and air conditioning to each individual enclosure as it is formed. When the ceiling unit 20 is folded, the flexible conduit 70 collapses in accordion fashion. Light fixtures (not shown) may also be permanently installed in the foldable ceiling unit 20.

From FIG. 1, it will be seen that a dividing wall 28 is joined by a hinge 29 to side wall panel **26*a* so as to be integral with panel 26*a*. Dividing wall 28 is maintained in a closed position, such as shown by dividing wall 28*a*, by a latch mechanism (not shown) on the inside of the wall panel 26. Similarly, when opened, dividing wall 28 is latched to support wall 32 to keep the dividing wall 28 open. As illustrated, dividing wall 28 may be arcuately displaced in the direction of arrow 31 until it is essentially parallel with support wall 32 so as to open up the side wall panel 26*a* between the two enclosures formed by room module assemblies 24 and 24*a*. The dividing wall 28 should be large enough to permit substantially the entire wall panel 26*a* to be opened up, thereby forming essentially one room twice the size of the two previous rooms. Thus, by providing a dividing wall 28 between each pair of rooms formed by the wall panels 26 and 30**, rooms of varying size may be selectively formed. This greatly increases the flexibility and usefulness of the collapsible room modules of the present invention.

It should further be noted that when dividing wall 28 has been arcuately displaced to the open position, the frame 27 which borders dividing wall 28 continues to support the ceiling unit 20. Thus, as shown in FIG. 1, ceiling unit 20 may be folded or unfolded even when dividing wall 28 is in the open position.

Figure 6:
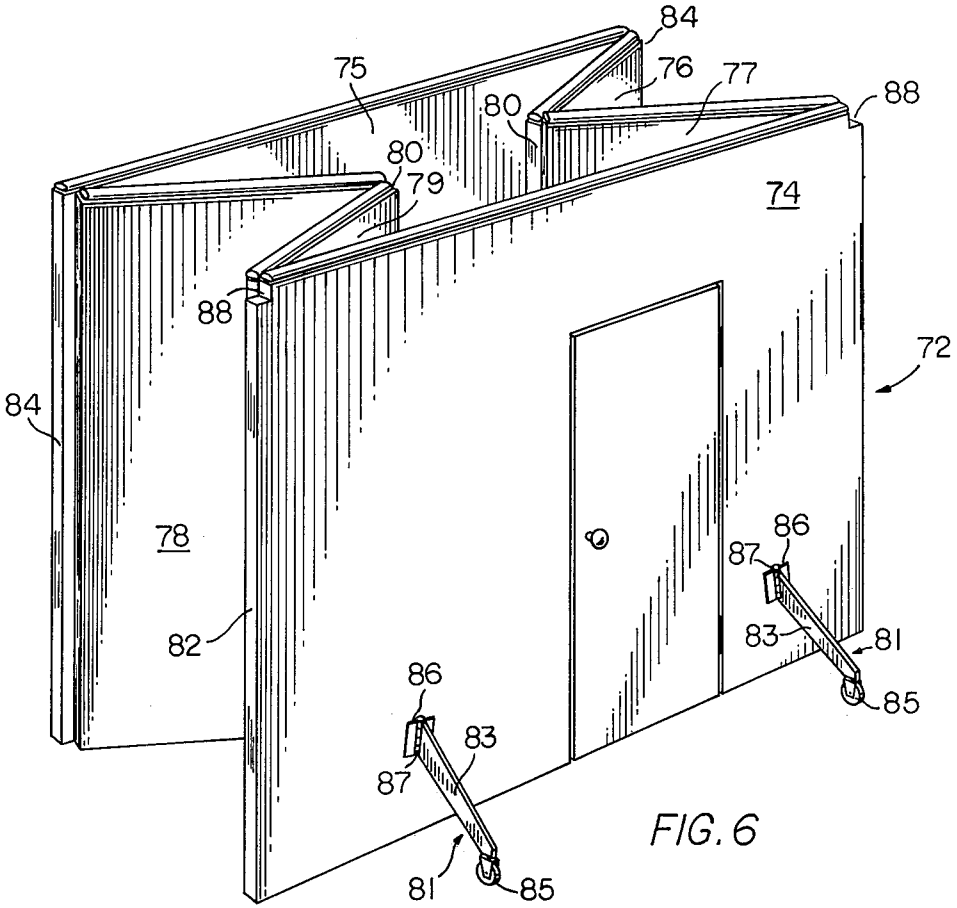
FIG. 6 is a perspective view schematically illustrating a portable room module assembly.
Figure 7:
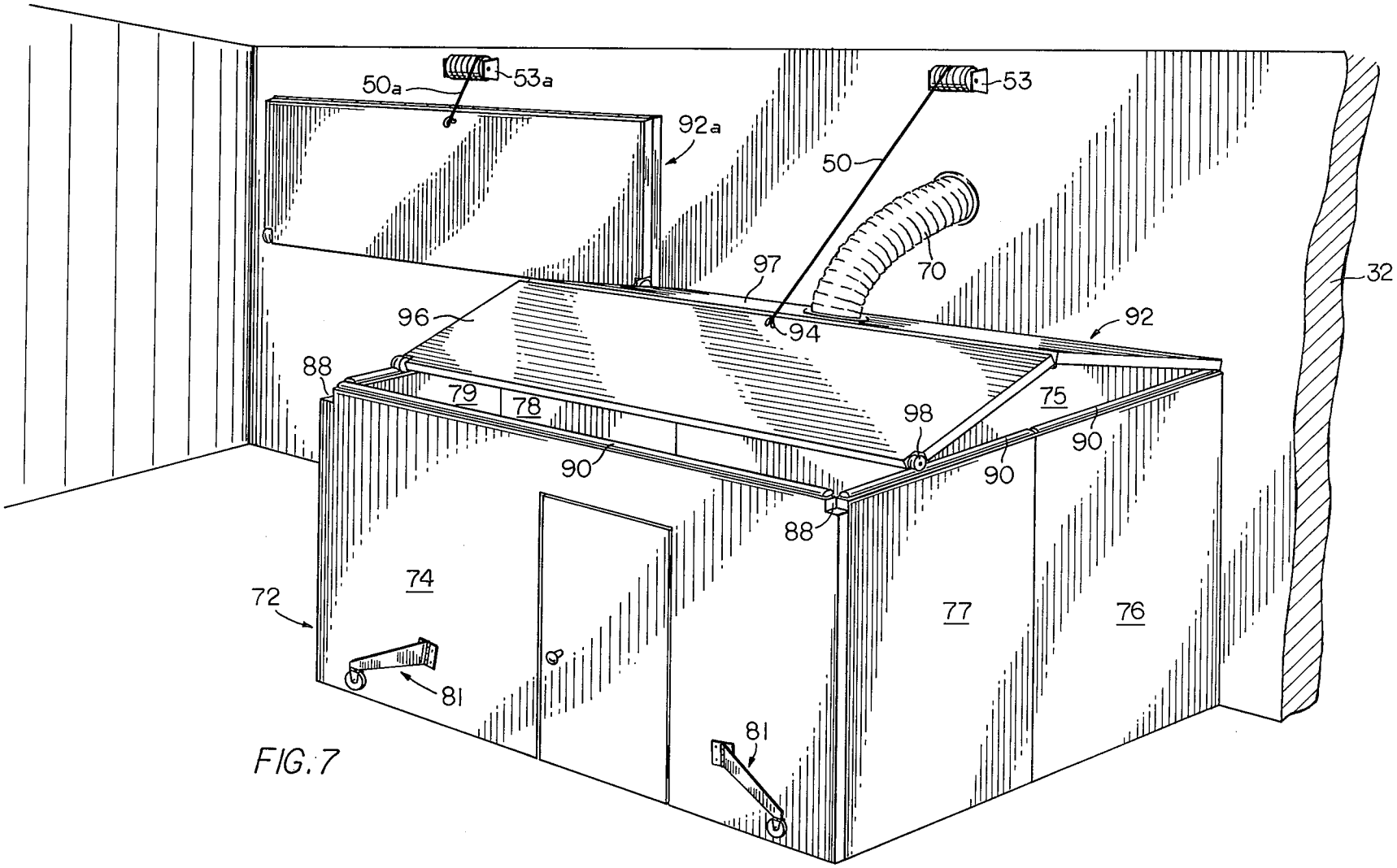
FIG. 7 is a schematic perspective view of a second presently preferred embodiment of the foldable ceiling unit used in conjunction with the portable room module assembly of FIG. 6.

Reference is now made to FIGS. 6 and 7 which illustrate a second presently preferred embodiment of the foldable ceiling unit used in conjunction with a portable room module assembly.

As shown in FIG. 6, the portable room module assembly generally designated 72 includes a front wall panel 74, a rear wall panel 75 and four side wall panels 76–79. Side wall panels 77 and 79 are hingedly connected at joints 82 to the front wall panel 74. Similarly, the side wall panels 76 and 78 are hingedly connected at joints 84 to the rear wall panel 75. Further, the side wall panels 78 and 79 are hingedly connected together at joint 80. Side wall panels 76 and 77 are similarly joined. The hinged connections between each of the wall panels 74–79 allows the room module assembly 72 to be folded into an essentially planar configuration for purposes of storage. Likewise, the portable room module assembly 72 may also be unfolded so that the side wall panels 76–79 are essentially normal between front wall panel 74 and rear wall panel 75. Once unfolded, wall panels 74–79 may be locked in the unfolded position by a bolt mechanism (not shown) such as that disclosed in U.S. Pat. No. 3,984,949.

Each vertical joint 80, 82 and 84 of the portable room module assembly 72 is provided with a tubular insulator (not shown) such as that described above in connection with FIGS. 1, 4 and 5. The tubular insulator is mounted upon one of the surfaces formed in the joint, e.g. along the vertical edge of the side wall panels 76–79. Thus, when the portable room module assembly 72 is unfolded such that side wall panels 76–79 are essentially normal between front wall panel 74 and rear wall panel 75, the tubular insulation strip (not shown) will be compressed, thereby forming an acoustic and hermetic insulation at each vertical joint 80, 82 and 84 of the assembly 72.

Movement of the room module assembly 72 is facilitated by suspending each wall panel 74–79 on a plurality of spring loaded rollers (not shown) such as those disclosed in U.S. Pat. No. 3,984,949. It has been found that when the room module assembly 72 is folded into the essentially planar configuration, it may have some inherent instability when moved from place to place. This instability results from the fact that the wall panels, which may be between seven and eight feet tall, have only a very narrow base upon which they are supported. Accordingly, stabilizers generally designated 81 are attached to the front and rear wall panels 74 and 75 and project outwardly away from the center of gravity of the room module assembly 72. The stabilizers 81 include a leg 83 to which a rotatable caster 85 has been attached. The caster 85 facilitates the displaceability of the folded room module assembly 72. The leg 83 is connected by a hinge 87 to a bracket 86. Preferably, the bracket is aligned such that when the leg 83 is rotated from the unfolded position to the folded (see FIG. 7) position, the caster 85 is lifted away from the floor. Also, the hinge 87 preferably has a bias point which resists movement of the leg 83 once it has been placed in either the folded or unfolded position. Portable room module assemblies such as that described above are known in the art (see U.S. Pat. No. 3,984,949) and may be purchased from Building Components Research, Inc., of Salt Lake City, Utah.

Reference is now made to FIG. 7 which illustrates the method in which the foldable ceiling unit may be used in conjunction with the portable room module assembly 72 described above. The foldable ceiling unit 92 shown in FIG. 7 is essentially identical in its structure and operation to ceiling unit 20 described above in connection with FIGS. 1 and 3.

The portable room module 72 is first wheeled into position under the foldable ceiling 92 mounted upon support wall 32 and then unfolded in the manner described previously. After the assembly 72 has been unfolded, it is desirable to fix the position of the assembly 72 on the floor to assure that the assembly 72 is in register with the ceiling unit 92. For this purpose, a down bolt (not shown) or other suitable anchoring device may be mounted on one or more of the wall panels 74–79 for anchoring the assembly in a predetermined position in register with ceiling unit 92. Such anchoring devices are well known in the art. See, for example, U.S. Pat. No. 3,984,949. Once the room module 72 has been unfolded and anchored in position as illustrated in FIG. 7, it is then ready to receive the ceiling unit 92. As previously described, the winch assembly 53 is operated so as to let out the cable 50 which is attached at one end to hook 94 of ceiling panel 96. As the foldable ceiling unit 20 is unfolded in the manner illustrated, it is guided accurately onto the enclosure formed by the room module 72 by tubular insulation strips 90 which engage the wheels 98 of the foldable ceiling unit 92 as described previously. Once the foldable ceiling unit 92 has been completely unfolded, wheels 98 are received by the notches 88 provided at the end of each of the side wall panels 77 and 79. In this manner, the wheels 98 will be disengaged from the tubular insulation strip 90 so that the ceiling panels 96 and 97 will lay essentially flat on the tubular insulation strip 90 thereby compressing the outer wall (not shown) of the insulation strip 90 against the rib (not shown). In this manner, as described previously in connection with FIG. 5, an acoustically and hermetically insulating seal will be formed by the insulation strip 90 between the walls panels 74–79 and the ceiling panels 96 and 97.

When it is desired to store the portable room module assembly 72, the foldable ceiling 92 may be folded into the storage configuration illustrated by foldable ceiling unit **92*a* in FIG. 7 by drawing in the cable 50 with winch assembly 53. After the foldable ceiling unit 92 has been folded, the room module assembly 72** may then be collapsed and transported to a remote location for storage.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. In an improved building structure for a collapsible room module usable for selectively transforming a large space into smaller spaces and having an assembly of generally vertically-oriented foldable front, rear and side wall panels for forming a room, the improvement comprising:

a foldable ceiling unit having at least two ceiling panels hinged together to accommodate (a) folding at least one of the ceiling panels with respect to the other into a storage configuration and (b) unfolding the ceiling panels to form a ceiling for the room formed by the wall panels;

wheels attached to said ceiling unit for accommodating unfolding of the panels; and means for guiding the ceiling unit as the wheels traverse at least a portion of the edges of the side wall panels when the ceiling unit is unfolded, said guiding means comprising means for acoustically and hermetically sealing the room around at least a portion of the ceiling's periphery when said ceiling unit is unfolded onto the room.

2. An improved building structure as defined in claim 1 wherein the improvement further comprises a dividing wall which is integral with at least one of the side wall panels and which is operable to selectively enlarge the interior space of the room by opening up the side wall panel.

3. An improved building structure as defined in claim 1 wherein said guiding means comprise a generally flexible tubular insulation strip attached to at least a portion of the edges of the wall panels and having an axially aligned inwardly directed rib which (a) acts as a track for guiding the ceiling unit as it traverses at least a portion of the edges of the wall panels while being unfolded and (b) forms a seal when the tubular strip is compressed against the rib by the weight of the unfolded ceiling unit, the guiding means further comprising at least one wheel attached to at least one of the ceiling panels and adapted to engage the rib of the insulation strip so as to be guided thereby, and means for disengaging the wheel from the insulation strip when the ceiling unit is substantially completely unfolded, thereby placing at least part of the weight of the unfolded ceiling unit on the tubular strip so as to form the seal.

4. An improved building structure as defined in claim 1 wherein the guiding means further comprise an incline which slopes downwardly toward the front of the room module, said incline being formed by the top edges of the wall panels and facilitating unfolding of the ceiling unit.

5. An improved building structure as defined in claim 1 wherein the ceiling unit comprises an air delivery opening and a light source which, when the ceiling unit is unfolded, deliver air and light to the room.

6. In an improved building structure of a collapsible room module usable for transforming a large space into one or more smaller spaces and having a plurality of hinged ceiling panels supported on wheels and an assembly of generally vertically-oriented foldable front, rear and side wall panels for forming a plurality of rooms, the improvement comprising:

a dividing wall for each pair of rooms, each dividing wall being integral with the side wall panel between each pair of rooms and being operable to open up the side wall panel between the pair of rooms so as to form essentially one room where before there were two rooms, said dividing wall comprising support means adapted to support the ceiling panels and providing a track for the wheels of said panels.

7. In an improved building structure of a collapsible room module usable for selectively transforming a large space into a plurality of smaller spaces and having an assembly of generally vertically-oriented foldable front, rear and side wall panels for forming a plurality of rooms, the improvement comprising:

a foldable ceiling unit for each room, said ceiling unit having at least two ceiling panels hinged together to accommodate (a) folding at least one of the ceiling panels with respect to the other into a storage configuration and (b) unfolding the ceiling panels to form a ceiling for the room, each ceiling unit further comprising wheels attached to at least one of the ceiling panels and means for guiding the wheels as they traverse at least a portion of the edges of the side wall panels when the ceiling unit is unfolded onto the room; and a dividing wall for each pair of rooms formed, the dividing wall being integral with the side wall panel between each pair of rooms and being operable to selectively open up the side wall panel between the rooms.

8. An improved building structure as defined in claim 7 wherein said guiding means comprise a generally flexible tubular insulation strip attached to at least a portion of the edges of the wall panels and having an axially aligned inwardly directed rib which (a) acts as a track for guiding the wheels of the ceiling unit as they traverse at least a portion of the edges of the wall panels while the ceiling is being unfolded and (b) forms a seal when the tubular strip is compressed against the rib by the weight of the unfolded ceiling unit, the guiding means further comprising means for disengaging the wheels from the insulation strip when the ceiling unit is substantially completely unfolded, thereby placing at least part of the weight of the unfolded ceiling unit on substantially the entire tubular strip so as to form the seal.

9. An improved building structure as defined in claim 8 wherein the guiding means further comprise an incline which slopes downwardly toward the front of the room module, said incline being formed by the top edges of the wall panels and facilitating unfolding of the ceiling unit.

10. An improved building structure defined in claim 9 wherein the ceiling unit comprises an air delivery opening and a light source which, when the ceiling unit is unfolded, deliver air and light to the room.

11. In an improved method of assembling room modules within a space by unfolding an assembly of front, rear and side wall panels to form an enclosure, and thereafter unfolding a plurality of hinged ceiling panels supported on wheels so as to form a ceiling for the enclosure, the improvement comprising the steps of:

guiding the ceiling unit onto the wall panels as the wheels of the ceiling unit traverse an insulation strip provided on at least a portion of the edges of the side wall panels while being unfolded onto the enclosure; and hermetically and acoustically sealing the enclosure around at least a portion of the periphery of the ceiling unit when it is unfolded, said sealing step comprising the step of compressing the insulation strip with the weight of the ceiling when it is unfolded.

12. A method as defined in claim 11 wherein said sealing step further comprises disengaging the wheels from the insulation strip when the ceiling unit is substantially completely unfolded, thereby placing at least part of the weight of the ceiling unit on substantially all of the tubular strip so as to form a seal.

13. A method as defined in claim 11 further comprising downwardly inclining the tubular strip traversed by the wheels of the ceiling unit so as to facilitate unfolding.

14. In an improved method of transforming a large space into a plurality of smaller spaces by unfolding an assembly of front, rear and side wall panels to form a plurality of rooms within the large space, the improvement comprising the steps of:

selectively enlarging the interior space of the rooms by opening a dividing wall provided in the side wall panels between adjacent rooms;

unfolding a plurality of hinged ceiling panels supported on wheels so as to form a ceiling for each room; and guiding each ceiling unit as the wheels of each unit traverse a track provided along the edges of the side wall panels between adjacent rooms.

15. A method as defined in claim 14 wherein said room modules have a tubular insulation strip attached to at least a portion of the edges of the wall panels and the ceiling unit has wheels adapted to engage the tubular strip and wherein said guiding step comprises traversing the tubular insulation strip with the wheels attached to the ceiling unit.

16. A method as defined in claim 15 wherein said guiding step further comprises disengaging the wheels from the insulation strip when the ceiling unit is substantially completely unfolded, thereby placing at least part of the weight of the ceiling unit on substantially all of the tubular strip so as to form a seal.

17. A method as defined in claim 16 wherein said unfolding step comprises downwardly inclining the tubular strip traversed by the wheels of the ceiling unit so as to facilitate unfolding.

* * * * *